US008973475B2

(12) United States Patent
Lai

(10) Patent No.: US 8,973,475 B2
(45) Date of Patent: Mar. 10, 2015

(54) TORSION ADJUSTING STRUCTURE OF A SCREWDRIVER

(71) Applicant: Jin Tsai Lai, Taichung (TW)

(72) Inventor: Jin Tsai Lai, Taichung (TW)

( * ) Notice: Subject to any disclaimer, the term of this patent is extended or adjusted under 35 U.S.C. 154(b) by 295 days.

(21) Appl. No.: 13/655,473

(22) Filed: Oct. 19, 2012

(65) Prior Publication Data

US 2014/0109732 A1 Apr. 24, 2014

(51) Int. Cl.
*B25B 23/142* (2006.01)
*B25B 15/00* (2006.01)

(52) U.S. Cl.
CPC ..... *B25B 23/1427* (2013.01); *B25B 15/00* (2013.01)
USPC ..... 81/475; 81/473; 73/862.191

(58) Field of Classification Search
USPC ..... 81/467, 473–476, 478, 480, 436; 73/862.08, 862.191, 862.21
See application file for complete search history.

(56) References Cited

U.S. PATENT DOCUMENTS

| | | | | |
|---|---|---|---|---|
| 4,346,633 | A * | 8/1982 | Rendl | 81/475 |
| 5,950,509 | A * | 9/1999 | Doong | 81/475 |
| 6,640,674 | B1 * | 11/2003 | Rinner et al. | 81/475 |
| 7,484,442 | B1 * | 2/2009 | Chen | 81/475 |
| 2005/0204876 | A1 * | 9/2005 | Chen | 81/473 |
| 2006/0016300 | A1 * | 1/2006 | Bubel | 81/475 |
| 2006/0162510 | A1 * | 7/2006 | Lee | 81/475 |
| 2012/0103148 | A1 * | 5/2012 | Lin | 81/475 |
| 2012/0210832 | A1 * | 8/2012 | Lai | 81/475 |

* cited by examiner

*Primary Examiner* — Monica Carter
*Assistant Examiner* — Melanie Alexander

(57) ABSTRACT

A torsion adjusting structure of a screwdriver includes an inner tube, a front micro-adjusting rod, a spring, an upper toothed block, a lower toothed block, a stop member, a compressive member, a regulating knob and an interacting member combined together, and the torsion adjusting structure is assembled in the handle of a screwdriver. To adjust the torsion of the screwdriver, an auxiliary tool is inserted in the polygonal recessed groove of the regulating knob to rotate the regulating knob having the graduation and number of a torsion value to be set by the regulating knob aligned to the position of an indication mark on the handle. Thus, the value of the torsion of a screwdriver can conveniently be regulated via the graduations and numbers on the regulating knob. Furthermore, the front micro-adjusting rod can carry out micro-adjustment of torsion.

6 Claims, 7 Drawing Sheets

TORSION ADJUSTING STRUCTURE OF A SCREWDRIVER

BACKGROUND OF THE INVENTION

1. Field of the Invention

This invention relates to a torsion adjusting structure of a screwdriver, particularly to one assembled in the interior of the handle of a screwdriver, able to adjust torsion value of a screwdriver by turning around a regulating knob assembled at the rear end of the handle and also having a function to carry out torsion micro-adjustment after the torsion value is set.

2. Description of the Prior Art

A conventional screwdriver for locking and loosening screws has a handle and a screwdriver shank immovably combined together. In most cases, a person employing such a conventional screwdriver does not know the torsion value which a screw is able to support and turns the screwdriver with force as he pleases. As a result, if the screwdriver is turned with an excessive force, the threads of the screw may get stripped or the recessed groove of the screw head may be damaged, thus causing the screw impossible to be loosened or locked. Another conventional screwdriver adjustable in torsion, as disclosed in a Taiwan utility model patented no. TWM306166, titled "Screwdriver with Fixed Torsion", includes a handle, a torsion member, a guiding-driving device, a stop piece and a sealing cover combined together. The torsion member consists of an elastic member and a slide block, and the elastic member is correspondingly received in an accommodating space of the handle and the slide block has its peripheral side formed with guide rails corresponding with the guide grooves of the handle so that the slide block can be exactly guided to slide in the accommodating space of the handle and stop the elastic member. The guiding-driving device is composed of a guiding piece and a driving rod, which are oppositely combined together. The driving rod has one end formed with a driving end to be orderly inserted through an insert hole of the slide block and the jointing holes of both the torsion member and the handle. The guiding piece is provided with a pushed face corresponding with the guiding pushing face of the slide block, and the driving rod and the guiding piece have their relative ends respectively formed with a positioning member. Thus, a torsion value of the screwdriver can be set by rotating the sealing cover of the screwdriver.

However, although the conventional screwdriver with fixed torsion has a function of setting a torsion valve, yet the limit of the torsion value set cannot be shown and a user cannot know an accurate torsion value of the screwdriver and hence, the number of circles of turning the sealing cover of the screwdriver must be reset every time when the screwdriver is to be used, inconvenient in use. In addition, the conventional screwdriver with fixed torsion can be adjusted in torsion only by its sealing cover but cannot carry out micro-adjustment when the torsion of the screwdriver is set.

SUMMARY OF THE INVENTION

The objective of this invention is to offer a torsion adjusting structure of a screwdriver, convenient to regulate the torsion of a screwdriver and able to carry out micro-adjustment of torsion.

A torsion adjusting structure of a screwdriver in the present invention consists of an inner tube, a front micro-adjusting rod, a spring, an upper tooth block, a lower tooth block, a stop member, a compressive member, a regulating knob, and an interacting member.

An inner tube has one end provided therein with an inner threaded hole and another end formed with an accommodating chamber disposed with a female thread, further formed with a polygonal through hole between the accommodating chamber and the inner threaded hole and having a wall cut with a slide groove communicating with the accommodating chamber and having a stop screw fixed therein.

A front micro-adjusting rod mounted at the front end of the inner tube has an outer wall provided with a male thread to be threadably combined with the inner threaded hole of the inner tube and its interior disposed with a stepped through hole.

A spring received in the interior of the inner tube has one end pushing against the inner wall of the stepped through hole of the front micro-adjusting rod.

An upper toothed block is set in both the accommodating chamber and the polygonal through hole of the inner tube and resists against another end of the spring. The upper toothed block is a polygonal body matching the polygonal through hole of the inner tube, bored with an insert hole and having one side provided with a plurality of upper engage teeth.

A lower toothed block is fixed in the accommodating chamber of the inner tube and meshed with the upper toothed block, bored with a polygonal insert hole and provided with a plurality of lower engage teeth on one side corresponding with the upper toothed block to be meshed with the upper engage teeth of the upper toothed block.

A stop member positioned in the accommodating chamber and closely leaning on one side of the lower toothed block is disposed with an insert hole and has a wall bored with a threaded hole for the stop screw to be screwed therein.

A compressive member is received in the female thread in the accommodating chamber of the inner tube, bored with a polygonal insert hole and having an outer wall provided with a male thread to be threadably combined with the female thread of the inner tube.

A regulating knob made of insulating material is mounted at the rear end of the inner tube, having an outer end formed with a polygonal recessed groove and further provided thereon with graduations and numbers and its inner end formed with a polygonal receiving groove.

An interacting member fitted in the polygonal receiving groove of the regulating knob is secured thereon with a polygonal connecting rod to be inserted in the polygonal insert hole of the compressive member.

The torsion adjusting structure of this invention is assembled in the handle of a screwdriver.

The inner tube of the torsion adjusting structure of this invention has a wall bored with a micro-adjustment fixing hole communicating with the inner threaded hole for fixing the front micro-adjusting rod at the front end of the inner tube.

The upper engage teeth of the upper toothed block and the lower engage teeth of the lower toothed block respectively have one side formed into a vertical face and another side into a beveling face to enable the upper toothed block and the lower toothed block to be actuated to carry out one-way rotation.

The regulating knob of the torsion adjusting structure of this invention has an outer wall oppositely formed with two blocking portions to be engaged in the handle of a screwdriver.

The polygonal receiving groove of the regulating knob is secured therein with a polygonal positioning projection, and the interacting member is a polygonal body with the same shape as the polygonal receiving groove of the regulating knob and has one end disposed with a polygonal recessed groove for receiving the positioning projection of the regulating knob.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
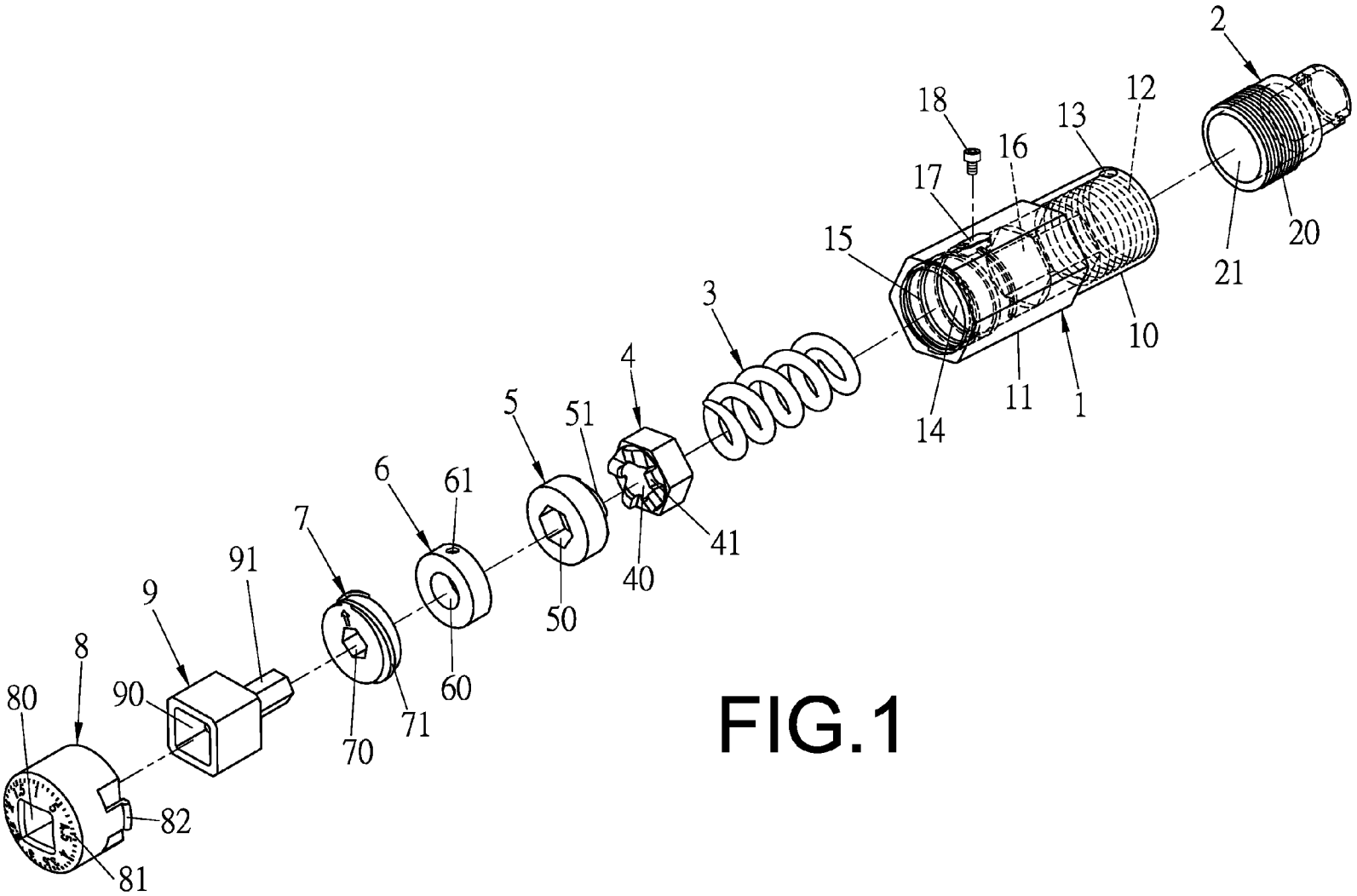
FIG. 1 is an exploded perspective view of a torsion adjusting structure of a screwdriver in the present invention.
Figure 2:
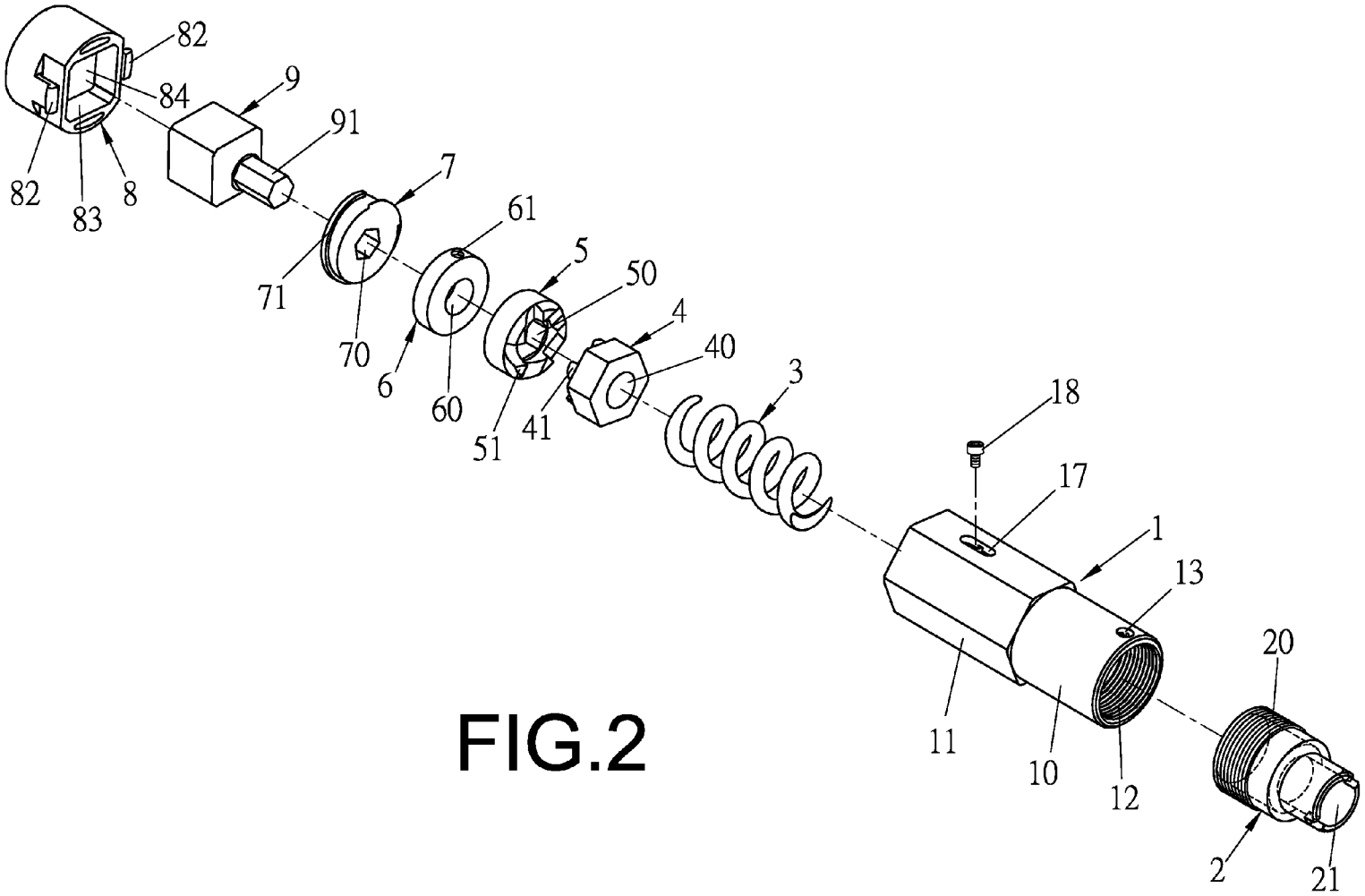
FIG. 2 is an exploded perspective view of the torsion adjusting structure of a screwdriver viewed at another angle in the present invention.

A preferred embodiment of a torsion adjusting structure of a screwdriver in the present invention, as shown in FIGS. 1-4, includes an inner tube 1, a front micro-adjusting rod 2, a spring 3, an upper toothed block 4, a lower toothed block 5, a stop member 6, a compressive member 7, a regulating knob 8 and an interacting member 9 as main components combined together.

The inner tube 1 has one end formed into a cylindrical body 10 and another end into a polygonal body 11, which can be a hexagon. The cylindrical body 10 of the inner tube 1 has an interior provided with an inner threaded hole 12 and its wall bored with a micro-adjusting hole 13 communicating with the inner threaded hole 12. The polygonal body 11 has an interior formed with an accommodating chamber 14 and an inner wall disposed with a female thread 15. A polygonal through hole 16, which can be a hexagon, is formed between the accommodating chamber 14 and the inner threaded hole 12 of the inner tube 1. Further, the polygonal body 11 has a wall cut with a slide groove 17 communicating with the accommodating chamber 14 and having a stop screw 18 fixed therein.

The front micro-adjusting rod 2 to be assembled at the front end of the inner tube 1 has an outer wall provided with a male thread 20 and its interior disposed with a stepped through hole 21.

The spring 3 is positioned in both the polygonal through hole 16 of the inner tube 1 and the stepped through hole 21 of the front micro-adjusting rod 2.

The upper toothed block 4 received in the accommodating chamber 14 and the polygonal through hole 16 of the inner tube 1 is a polygonal body to match the polygonal through hole 16 of the inner tube 1, bored with an insert hole 40 and having one side provided with a plurality of upper engage teeth 41 respectively having one side formed into a vertical face and another side into a beveling face.

The lower toothed block 5 is positioned in the accommodating chamber 14 of the inner tube 1 and engaged with the upper toothed block 4, bored with a polygonal insert hole 50 and provided with a plurality of lower engage teeth 51 on one side abutting on the upper toothed block 4, and the lower engage teeth 51 respectively have one side formed into a vertical face and another side a beveling face.

The stop member 6 is received in the accommodating chamber 14 of the inner tube 1 and located at one side of the lower toothed block 5, provided with an insert hole 60 and having a wall bored with a threaded hole 61.

The compressive member 7 received in the female thread 15 in the accommodating chamber 14 of the inner tube 1 is bored with a polygonal insert hole 70 and has an outer wall provided with a male thread 71.

The regulating knob 8 made of insulating material is mounted at the rear end of the inner tube 1 and has its outer end disposed with a polygonal recessed groove 80, which can be a tetragon. The regulating knob 8 further has its outer end surface annularly provided with graduations and numbers 81, its outer wall oppositely formed with two blocking portions 82 and its inner end disposed with a polygonal receiving groove 81 fixed therein with a polygonal positioning projection 84.

The interacting member 9 secured in the polygonal receiving groove 83 of the regulating knob 8 is a polygonal body with the same shape as that of the polygonal receiving groove 83, having one end formed with a polygonal recessed groove 90 and another end fixed thereon with a polygonal connecting rod 91.

Figure 3:
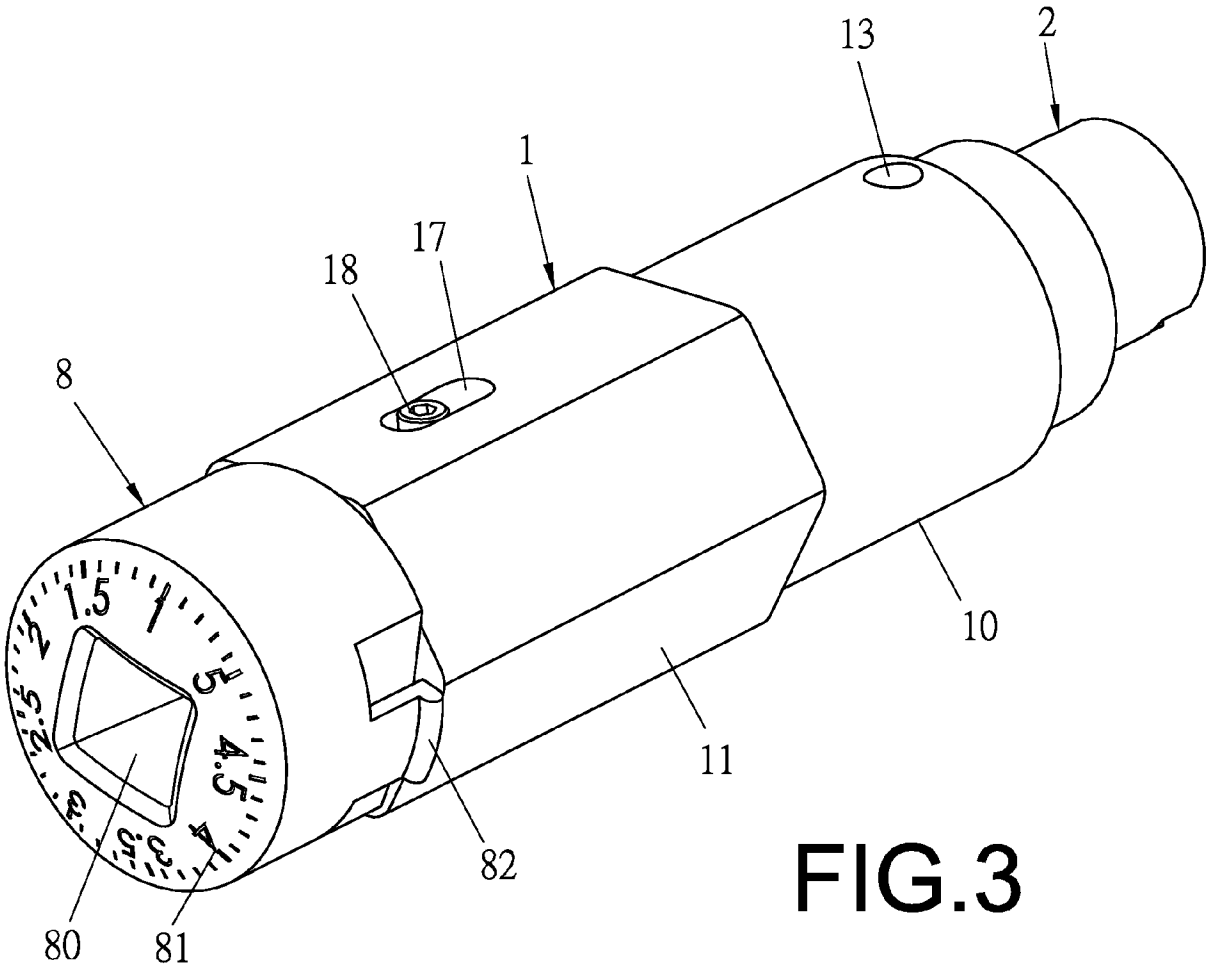
FIG. 3 is a perspective view of the torsion adjusting structure of a screwdriver in the present invention.

In assembling, referring to FIGS. 1-4, firstly, the front micro-adjusting rod 2 has the male thread 20 threadably secured in the inner threaded hole 12 of the inner tube 1, and the spring 3 is set in both the polygonal through hole 16 of the inner tube 1 and the stepped through hole 21 of the front micro-adjusting rod 2. Then, the upper toothed block 4 is positioned in the accommodating chamber 14 and the polygonal through hole 16 of the inner tube 1, making parts of the upper toothed block 4 engaged in the polygonal through hole 16 and letting one end of the spring 3 push against the inner wall of the stepped through hole 21 of the front micro-adjusting rod 2 and another end resisting against one side of the upper toothed block 4. Next, the lower toothed block 5 is assembled in the accommodating chamber 14 of the inner tube 1 to have the lower engage teeth 51 of the lower toothed block 5 meshed with the upper engage teeth 41 of the upper toothed block 4, and the stop member 6 is fixed in the accommodating chamber 14 of the inner tube 1 to have the stop member 6 closely contacting with the lateral face of the lower toothed block 5 and then, the stop screw 18 is inserted through the slide groove 17 of the inner tube 1 and screwed in the threaded hole 61 of the stop member 6 for restrictedly positioning the stop member 6 in the accommodating chamber 14 of the inner tube 1. Subsequently, the compressive member 7 is set in the accommodating chamber 14 of the inner tube 1 to have the male thread 71 of the compressive member 7 threadably combined with the female thread 15 of the inner tube 1, letting the compressive member 7 closely contact with the sidewall of the stop member 6. Afterward, the interacting member 9 is fitted in the polygonal receiving groove 83 of the regulating knob 8 to have the positioning projection 84 in the polygonal receiving 83 of the regulating knob 8 secured in the polygonal recessed groove 90 of the interacting member 9 for positioning the interacting member 9 on the regulating knob 8. Lastly, the regulating knob 8 and the interacting member 9 are together fixed at the rear end of the inner tube 1 to have the polygonal connecting rod 91 of the interacting member 9 inserted through the polygonal insert hole 70 of the compressive member 7 and in the insert hole 60 of the stop member 6, thus finishing assembly of the torsion adjusting structure of a screwdriver, as shown in FIG. 3.

Figure 4:
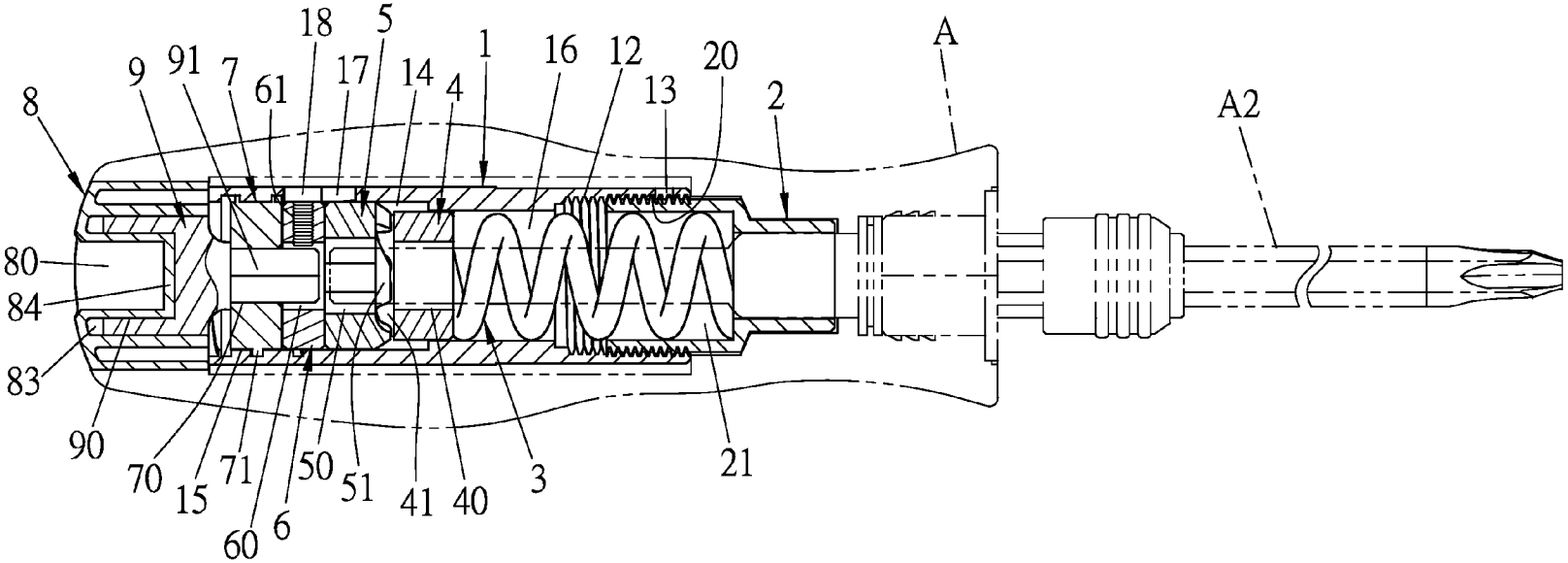
FIG. 4 is a cross-sectional view of the torsion adjusting structure of a screwdriver in the present invention, illustrating that the torsion adjusting structure is assembled in the interior of a handle and combined with a screwdriver shank.
Figure 5:
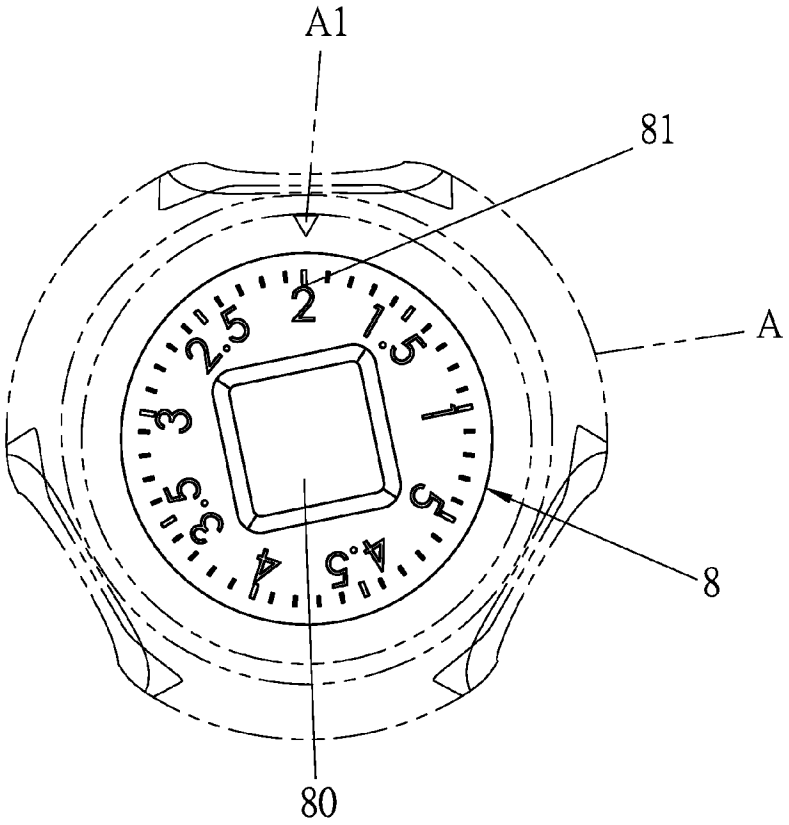
FIG. 5 is an end view of a regulating knob and a handle of the torsion adjusting structure of a screwdriver in the present invention.

Before the torsion adjusting structure of a screwdriver of this invention is assembled in the handle (A) of a screwdriver, it is necessary to set different torsion values. Referring to FIGS. 3-5, a polygonal tool can be inserted in the polygonal recessed groove 80 at the outer end of the regulating knob 8 to drive the regulating knob 8 together with the interacting member 9 to rotate and actuate the compressive member 7 to turn around and thus, the compression piece 7 can be turned to move toward the interior or the exterior of the inner tube 1 via mutually threaded combination of male thread 71 of the compressive member 7 with the female thread 15 of the inner tube 1. When a comparatively large torsion value is to be set, the compressive member 7 is turned and moved inward to drive the stop member 6 to shift inward and push the lower toothed block 5 to tightly contact with the sidewall of the upper toothed block 4 and meanwhile, the upper toothed block 4 is elastically pushed by the spring 3. Thus, the lower engage teeth 51 of the lower toothed block 5 and the upper engage teeth 41 of the upper toothed block 4 can be mutually engaged with great tightness to produce a comparatively large torsion value. When a comparatively small torsion value is to be set, the compressive member 7 is driven to shift outward, and the stop piece 6 together with the lower toothed block 5 and the upper toothed block 4 are elastically pushed by the spring 3 and moved outward, too. At this time, the lower toothed block 5 and the upper toothed block 4 are no longer engaged with great tightness and hence the torsion value becomes comparatively small. Substantially, the torsion value set is confined by a moving distance of the stop member 6, and the moving distance of the stop piece 6 is restricted by a distance that the stop screw 18 is moved in the slide groove 17 of the inner tube 1, thus able to control the travel of the torsion value set. In addition, the elastic compression force of the spring 3 can be regulated by turning the front micro-adjusting rod 2 to push against or separate from the spring 3 provided in the inner tube 1. After the front micro-adjusting rod 2 carries out micro-adjustment to a setting value, seal up the micro-adjusting hole 13 on the inner tube 1 to have the front micro-adjusting rod 2 immovably secured in the inner tube 1. When a torsion value set is larger, have a comparatively large numerical value on the regulating knob 8 aligned to an indication mark A1 on the handle (A); when a torsion value set is comparatively small, have a comparatively small numerical value on the regulating knob 8 aligned to the indication mark A1 on the handle (A). Thus, the torsion adjusting structure can be assembled in the interior of the handle (A) of a screwdriver.

Figure 6:
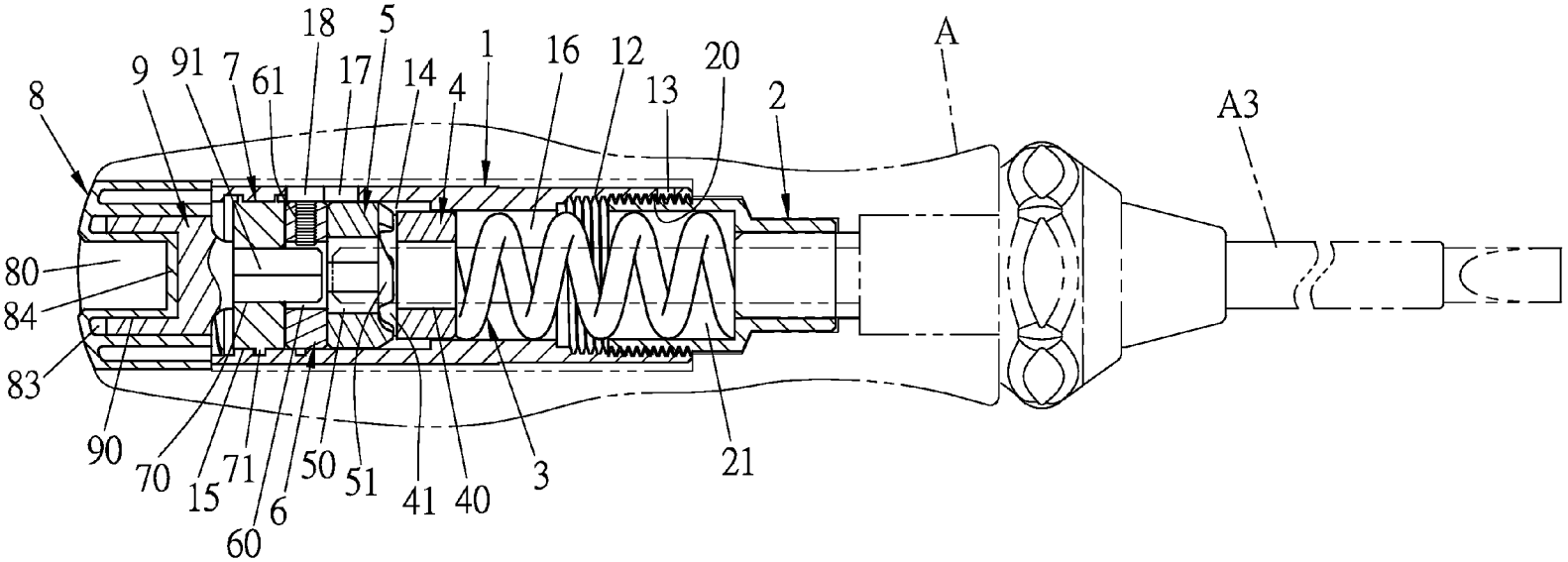
FIG. 6 is a cross-sectional view of the torsion adjusting structure of a screwdriver in the present invention, illustrating that the torsion adjusting structure is assembled in the interior of the handle and combined with another screwdriver shank.
Figure 7:
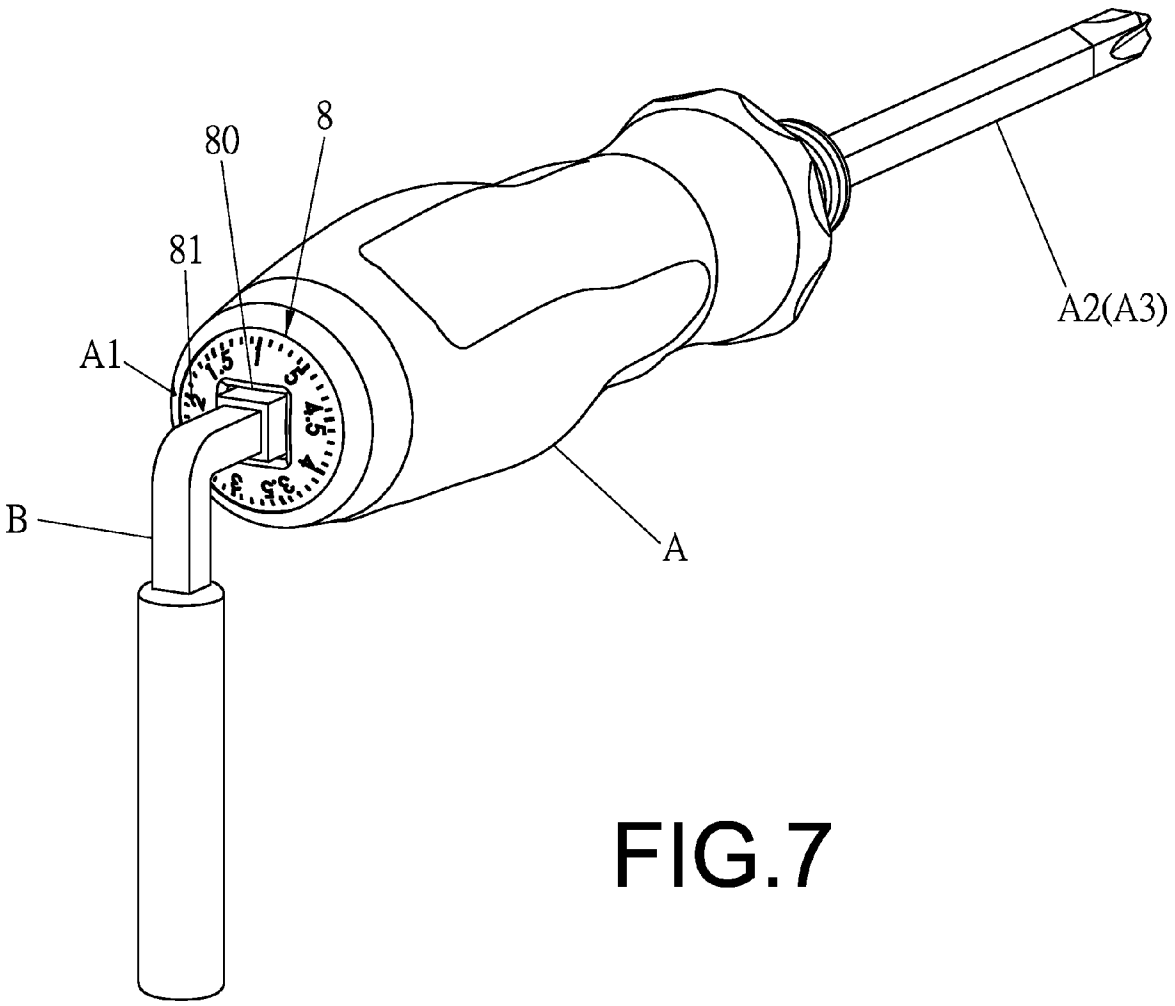
FIG. 7 is schematic view of the torsion adjusting structure of a screwdriver in the present invention, illustrating that torsion adjustment of a screwdriver is done by means of an auxiliary tool.

In using, referring to FIGS. 3-7, after the torsion adjusting structure is assembled in the handle (A), as shown in FIG. 4, the handle (A) can be combined with different screwdriver shanks $A_2$, $A_3$ for use, as shown in FIGS. 4 and 6. To adjust different torsion of the screwdriver shank, only have an auxiliary tool (B) inserted in the polygonal recessed groove 80 of the regulating knob 8 at the rear end of the handle (A), as shown in FIG. 7, and turned to drive the regulating knob 8 to rotate and have the graduations and numbers 81 on the torsion value of the regulating knob 8 aligned to the indication mark A1 on the handle (A) to finish torsion adjustment of the screwdriver shank $A_2$, $A_3$. Thus, the value of the torsion of a screwdriver can conveniently be adjusted via the graduations and numbers 81 on the regulating knob 8.

While the preferred embodiment of the invention has been described above, it will be recognized and understood that various modifications may be made therein and the appended claims are intended to cover all such modifications that may fall within the spirit and scope of the invention.

What is claimed is:

1. A torsion adjusting structure of a screwdriver comprising:

an inner tube having one end provided with an inner threaded hole, said inner tube having another end formed with an accommodating chamber, said accommodating chamber having a wall disposed with a female thread, said inner tube provided with a polygonal through hole between said accommodating chamber and said inner threaded hole, said inner tube having a wall cut with a slide groove communicating with said accommodating chamber, said slide groove set therein with a stop screw;

a front micro-adjusting rod assembled at a front end of said inner tube, said front micro-adjusting rod having an outer wall formed with a male thread to be threadably combined with said inner threaded hole of said inner tube, said front micro-adjusting rod provided with a stepped through hole in an interior;

a spring received in an interior of said inner tube, said spring having one end pushing against an inner wall of said stepped through hole of said front micro-adjusting rod;

an upper toothed block positioned in both said accommodating chamber and said polygonal through hole of said inner tube and resisting against another end of said spring, said upper toothed block being polygon-shaped for matching said polygonal through hole of said inner tube, said upper toothed block bored with an insert hole, said upper toothed block having one side provided with a plurality of upper engage teeth;

a lower toothed block set in said accommodating chamber of said inner tube and meshed with said upper toothed block, said lower toothed block formed with a polygonal insert hole, said lower toothed block provided with a plurality of lower engage teeth at one side abutting on said upper toothed block to be meshed with said upper engage teeth of said upper toothed block;

a stop member received in said accommodating chamber of said inner tube and closely leaning on one side of said lower toothed block, said stop member disposed with an insert hole, said stop member having a wall bored with a threaded hole for said stop screw to be screwed therein;

a compressive member fixed in said female thread of said accommodating chamber of said inner tube, said compressive member formed with a polygonal insert hole, said compressive member having an outer wall provided with a male thread to be threadably combined with said female thread of said inner tube;

a regulating knob assembled at a rear end of said inner tube, said regulating knob made of insulating material, said regulating knob having an outer end formed with a polygonal recessed groove and provided thereon with graduations and numbers, said regulating knob having an inner end disposed with a polygonal receiving groove; and an interacting piece fitted in said polygonal receiving groove of said regulating knob, said interacting piece secured thereon with a polygonal connecting rod, said polygonal connecting rod inserted in said polygonal insert hole of said compression piece.

2. The torsion adjusting structure of a screwdriver as claimed in claim 1, wherein said torsion adjusting structure is assembled in a handle of a screwdriver.

3. The torsion adjusting structure of a screwdriver as claimed in claim 1, wherein said inner tube has a wall bored with a micro-adjusting hole communicating with said inner threaded hole.

4. The torsion adjusting structure of a screwdriver as claimed in claim 1, wherein said upper engage teeth of said upper toothed block and said lower engage teeth of said lower toothed block respectively have one side formed into a vertical face and another side into a beveling face.

5. The torsion adjusting structure of a screwdriver as claimed in claim 1, wherein said regulating knob has outer wall oppositely disposed with two blocking portions to be engaged in the handle of a screwdriver.

6. The torsion adjusting structure of a screwdriver as claimed in claim 1, wherein said polygonal receiving groove of said regulating knob is fixed therein with a polygonal positioning projection, and said interacting member is a polygonal body with the same shape as said polygonal receiving groove of said regulating knob, said interacting member having one end provided with a polygonal recessed groove for receiving said positioning projection of said regulating knob.

* * * * *